United States Patent [19]

Aliprandini

[11] 4,364,804

[45] Dec. 21, 1982

[54] BATH FOR THE GALVANOPLASTIC DEPOSITION OF A YELLOW-GOLD TINTED METALLIC ALLOY

[76] Inventor: Pino Aliprandini, 98D, route de Thonon, Vesenaz, Geneve, Switzerland

[21] Appl. No.: 283,901

[22] Filed: Jul. 16, 1981

Related U.S. Application Data

[63] Continuation-in-part of Ser. No. 159,300, Jun. 13, 1980, abandoned.

[30] Foreign Application Priority Data

Mar. 17, 1980 [CH] Switzerland ..... 2067/80

[51] Int. Cl.[3] ..... C25D 3/58

[52] U.S. Cl. ..... 204/44

[58] Field of Search ..... 204/44, 123

[56] References Cited

U.S. PATENT DOCUMENTS 2,886,500 5/1959 Bride ..... 204/44

2,989,448 6/1961 France ..... 204/44

FOREIGN PATENT DOCUMENTS 361892 12/1906 France ..... 204/44

OTHER PUBLICATIONS

Frederick A. Lowenheim, "Modern Electroplating", pp. 12–13, (1963).

*Primary Examiner*—G. L. Kaplan
*Attorney, Agent, or Firm*—Emory L. Groff, Jr.

[57] ABSTRACT

A bath for the galvanoplastic deposition of a yellow-gold tinted metallic alloy on a nickel-plated, stainless steel or brass support contains copper, zinc and lead salts, an alkaline metal stannate and cyanide the whole in an alkaline medium and with a wetting agent added. The metallic alloy deposited by galvanoplasticity in such bath is of a yellow-gold tint and constitutes a sub-layer permitting the reduction of the thickness of a gold layer which will be superposed thereon.

1 Claim, No Drawings

BATH FOR THE GALVANOPLASTIC DEPOSITION OF A YELLOW-GOLD TINTED METALLIC ALLOY

This application is a continuation-in-part of my application Ser. No. 159,300, filed June 13, 1980, now abandoned.

The present invention relates to a bath for the galvanoplastic deposition of a yellow-gold tinted metallic alloy, brilliant at all thicknesses, on a nickel-plated, stainless steel or brass support.

Because of the constant increase in the price of gold, research has been carried out to reduce the thickness of the layer of gold plate on pieces of jewellery, watch cases, etc. This done, the danger of seeing the rapid appearance of the white layer of sub-jacent nickel as a result of wear, increases.

To remedy this inconvenience, the bath in accordance with the invention permits the deposition of a relatively thick yellow-gold tinted brilliant metallic sub-layer, of the order of 50 microns, on which there is subsequently deposited in known manner a fine layer of gold.

According to the present invention there is provided a bath for the galvanoplastic deposition of a yellow-gold tinted metallic alloy on a nickel-plated, stainless steel or brass support, in which the bath contains copper, zinc and lead salts, an alkaline metal stannate and cyanide in an alkaline medium and with a wetting agent added thereto.

Preferably, the copper is in the form of a double cyanide in an amount of from 10 to 20 g of metal per liter, the zinc in the form of a cyanide or a sulphate in an amount of from 0.01 to 4 g of metal per liter, the lead in the form of an acetate in an amount of from 2 to 50 mg of metal per liter, the stannate in the form of potassium stannate in an amount of from 2 to 10 g of tin per liter, the cyanide in the form of potassium cyanide in an amount of from 30 to 60 g per liter of free cyanide.

Further preferably, the bath additionally contains 1 to 50 cc of ammonia per liter, 5 to 200 g of potassium and sodium double tartrate per liter, 1 to 20 g of potassium carbonate per liter, the whole being such as to maintain the bath at a pH of from 9 to 12.

A bath in accordance with the invention can be formulated as in the following Example:

EXAMPLE

| | Concentration of metallic salts expressed in weight of metal per liter |
|---|---|
| Double cyanide of copper | 10 to 20 g, preferable 17G |
| Potassium stannate | 2 to 10 g, preferably 6g |
| Zinc cyanide or sulphate | 0.1 to 4 g, preferably 2g |
| Lead acetate | 2 to 50mg, preferably 20g |
| | **Concentration of auxiliary products** |
| Potassium cyanide | 75g/l |
| Potassium carbonate | 1 to 20g/l, preferably 10g/l |
| Potassium & sodium tartrate | 5 to 200g/l, preferably 100g/l |
| Concentrated Aqueous ammonia (28% $NH_3$) | 1 to 50cc/l, preferably 20cc/l |
| Wetting agent FCGB of IMPAG S.A., Zurich | 1cc/l |
| pH of bath | 9 to 12, preferably 11 to 12 |
| Amount of free cyanide in bath | 30 to 60 g/l |

When utilizing this bath at a temperature of 45° C. to 50° C. with insoluble anodes, preferably of stainless steel, stabilized, a cathodic current density of 1 to 2 Amp/dm$^2$, there can be deposited on the cathode, an amount of 0.5 to 1.0 microns per minute, an alloy comprising 78% Cu, 5% Zn, 16% Sn and 1% Pb presenting a yellow-gold tint of 2 N quality, particularly brilliant, of a hardness of 260 to 280 Hv (kg/mm$^2$) with a very good resistance to wear.

The galvanoplastic deposition of a fine layer of gold on this metallic sub-layer is preferably effected in an alkaline bath containing gold, copper, cadmium and silver. This layer of gold can subsequently be tinted at will in an acid bath containing gold, nickel, cobalt and indium, for example.

I claim:

1. An aqueous bath having a pH from 9 to 12 for the galvanoplastic deposition of a yellow-gold tinted metallic alloy on a nickel-plated, stainless steel or brass substrate containing 10 to 20 g/l of copper in the form of a double cyanide, 2 to 10 g/l of tin in the form of potassium stannate, 0.01 to 4 g/l of zinc in the form of a cyanide or sulfate, 2 to 50 mg/l of lead in the form of an acetate, 30 to 60 g/l of potassium and sodium double tartrate, 1 to 50 g/l of concentrated aqueous ammonia (28% $NH_3$), 1 to 20 g/l of potassium carbonate and a wetting agent.

* * * * *